United States Patent [19]

Turner

[11] 4,019,726

[45] Apr. 26, 1977

[54] CAM LOCK JAWS FOR MACHINIST VISE

[75] Inventor: Lester Willis Turner, Longmont, Colo.

[73] Assignee: The Raymond Lee Organization, Inc., a part interest

[22] Filed: May 4, 1976

[21] Appl. No.: 683,012

[52] U.S. Cl. ..... 269/261

[51] Int. Cl.[2] ..... B25B 1/24

[58] Field of Search ..... 269/260, 261, 283, 99, 269/100

[56] References Cited

UNITED STATES PATENTS 1,393,083 10/1921 Campbell ..... 269/283

FOREIGN PATENTS OR APPLICATIONS 146,440 12/1903 Germany ..... 269/261

79,375 11/1918 Switzerland ..... 269/261

*Primary Examiner*—Al Lawrence Smith

*Assistant Examiner*—Robert C. Watson

[57] ABSTRACT

A machinist's vise has removable jaws. The jaws have cylindrical members which extend into the vise. Cylinders extend into the vise and are normally aligned with notches in the cylindrical members. The jaws may be removed by rotating the cylinders until notches in the cylinders become aligned with notches in the cylindrical members.

3 Claims, 4 Drawing Figures

CAM LOCK JAWS FOR MACHINIST VISE

SUMMARY OF THE INVENTION

This invention is designed to provide a machinist's vise having jaws which may be more easily changed than on the vises now in use. Briefly, it is the object of this invention to provide a device that will lock the jaws of the vise into the vise not by friction, but rather by the use of cooperating pieces with notches that can be aligned to release the jaws and that can be placed out of alignment to hold the jaws in place.

DETAILED DESCRIPTION OF PREFERRED EMBODIMENTS

Figure 1:
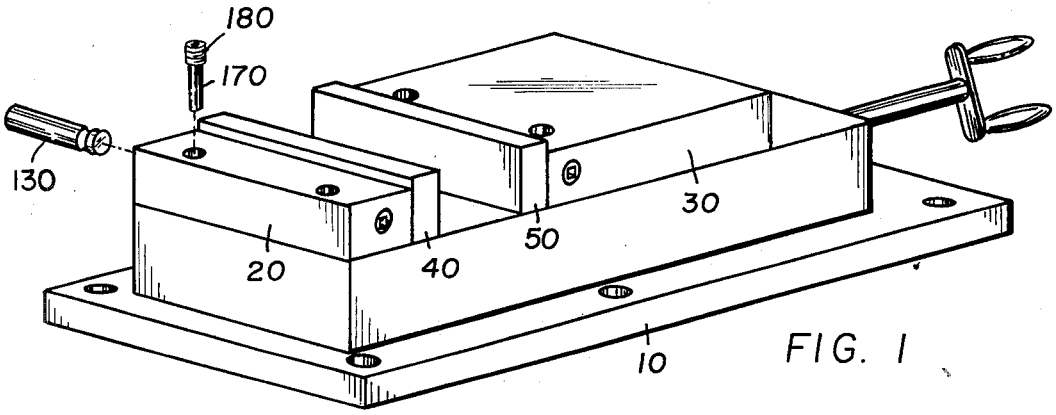
FIG. 1 illustrates the invention in use.
Figure 2:
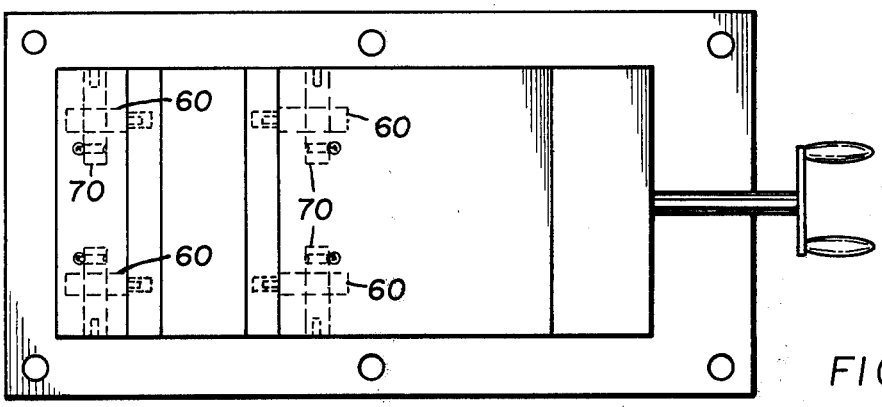
FIG. 2 is a top view of the invention.
Figure 3:
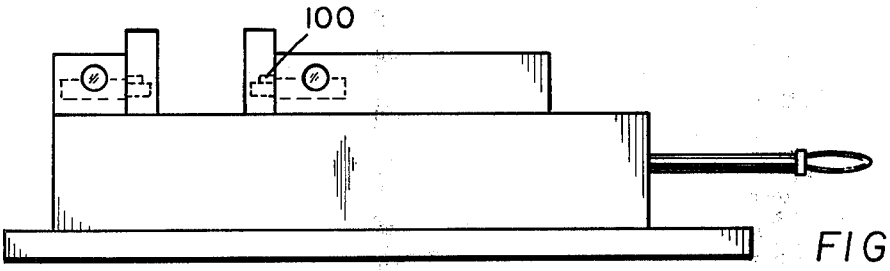
FIG. 3 is a side view of the invention.

A machinist's vise 10 has a fixed head 20 and a movable head 30. Jaws 40 and 50 are attached to heads 20 and 30, respectively.

Each of the heads has a pair of first cylindrical recesses 60. These recesses extend longitudinally through the heads, in a parallel fashion. It is to be noted that each recess in one head is co-axial with a corresponding recess in the other head. Moreover, all the first recesses are identical.

Each of the heads also has a pair of transversely extending second cylindrical recesses 70. Each pair is co-axial, and all second recesses are identical, with diameters equal to those of the first recesses.

The axes of the second recesses lie in a horizontal plane that is higher than the axes of the first recesses. Moreover, each second recess intersects a corresponding first recess to the depth of one-half the diameter of any recess.

Figure 4:
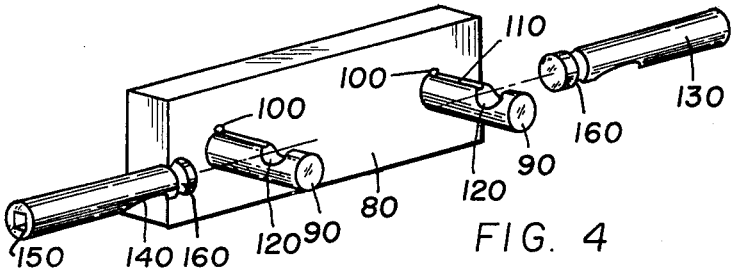
FIG. 4 illustrates the cooperation of various parts used in the invention.

As demonstrated in FIG. 4, each jaw 80 has two cylindrical members 90 extending perpendicularly away from it. These members have threaded ends engaging threaded recesses in the jaw. An Allen-head screw 100, threaded into the jaw just above each member, engages a groove 110 in that member to prevent the member from rotating. Moreover, each of the members has an upwardly facing, transversely extending semi-cylindrical notch 120. These notches are so located as to be aligned with the second recesses of any head into which members 90 extend.

Into each second recess is inserted a cylinder 130. Each cylinder also has a notch 140, which is similar in all respects to notch 120 except that notches 140 may be aligned with first recesses 60. It is to be noted that each cylinder is rotatable within the recess in which it is located by placing a ⅜ inch square drive in well 150 in the outward end of each cylinder. To retain the cylinders in their recesses, each cylinder has an annular groove 160 located between notch 140 and the inward end of the cylinder. Pins 170, inserted in the heads and kepts therein by threaded Allen heads 180 extend through the grooves 160 of the cylinders to prevent the latter from falling out of the recesses while permitting them to turn.

In use, all the cylinders are rotated so that their notches 140 are aligned with the peripheries of the first recesses. Then, the jaws are installed, with members 90 being inserted into the first recesses. Then, the cylinders are turned, to place solid metal in notches 120 and prevent the jaws from moving until the cylinders are rotated again.

I claim:

1. In combination:

a machinist's vise having a fixed head and a movable head, each head having first and second pairs of cylindrical recesses, the recesses in each first pair being parallel and being disposed longitudinally in the corresponding head, the recesses in each second pair being disposed along a common axis and being disposed transversely in the corresponding head, each first pair recess intersecting a corresponding second pair recess;

a pair of jaws, each jaw having two parallel spaced cylindrical members extending outward therefrom at right angles, each jaw being associated with a corresponding head with the members secured thereto extending into corresponding first pair recesses in the corresponding head; and four cylinders, each cylinder being disposed in a corresponding one of the two second pairs of recesses and being rotatable therein.

2. The combination of claim 1 wherein each of the cylindrical members has a transverse notch aligned with the periphery of the corresponding second recess and wherein each cylinder has a transverse notch alignable with the periphery of the corresponding first recess.

3. The combination of claim 2 wherein all recesses have the same diameter.

* * * * *